US009004053B1

(12) United States Patent
Anderson

(10) Patent No.: US 9,004,053 B1
(45) Date of Patent: Apr. 14, 2015

(54) STRING RELEASE FOR A CROSSBOW

(71) Applicant: Jeffrey R. Anderson, Wauconda, IL (US)

(72) Inventor: Jeffrey R. Anderson, Wauconda, IL (US)

( * ) Notice: Subject to any disclaimer, the term of this patent is extended or adjusted under 35 U.S.C. 154(b) by 133 days.

(21) Appl. No.: 13/784,822

(22) Filed: Mar. 5, 2013

(51) Int. Cl.
*F41C 27/00* (2006.01)
*F41B 5/14* (2006.01)
*F41B 5/12* (2006.01)

(52) U.S. Cl.
CPC ..... *F41B 5/1469* (2013.01); *F41B 5/12* (2013.01); *F41B 5/1473* (2013.01)

(58) Field of Classification Search
USPC ..... 124/25, 31, 25.2, 36, 37, 40, 44.5, 80
See application file for complete search history.

(56) References Cited

U.S. PATENT DOCUMENTS

| | | | | | |
|---|---|---|---|---|---|
| 4,192,281 | A | * | 3/1980 | King | 124/25 |
| 4,721,092 | A | * | 1/1988 | Waiser | 124/40 |
| 4,829,974 | A | | 5/1989 | Anderson | |
| 4,958,617 | A | | 9/1990 | Anderson | |
| 5,085,200 | A | * | 2/1992 | Horton-Corcoran et al. | 124/25 |
| 5,119,797 | A | | 6/1992 | Anderson | |
| 5,263,465 | A | | 11/1993 | Anderson | |
| 5,598,829 | A | * | 2/1997 | Bednar | 124/25 |
| 5,649,520 | A | * | 7/1997 | Bednar | 124/25 |
| 6,142,133 | A | | 11/2000 | Anderson | |
| 6,715,481 | B1 | | 4/2004 | Anderson | |
| 6,752,136 | B1 | | 6/2004 | Anderson | |
| 7,770,567 | B1 | * | 8/2010 | Yehle | 124/25 |
| 7,823,572 | B2 | | 11/2010 | Anderson | |
| 8,157,680 | B2 | | 4/2012 | Anderson | |
| 2002/0059924 | A1 | * | 5/2002 | Bednar | 124/25 |
| 2008/0035135 | A1 | * | 2/2008 | Pardoski | 124/35.2 |
| 2008/0060629 | A1 | * | 3/2008 | Chang | 124/25 |
| 2009/0064978 | A1 | * | 3/2009 | Matasic et al. | 124/35.1 |
| 2009/0194086 | A1 | * | 8/2009 | Kempf | 124/25 |
| 2011/0253118 | A1 | * | 10/2011 | Kempf | 124/25 |
| 2014/0182574 | A1 | * | 7/2014 | Darlington et al. | 124/35.1 |

* cited by examiner

*Primary Examiner* — Gene Kim
*Assistant Examiner* — John E Simms, Jr.
(74) *Attorney, Agent, or Firm* — Rolland R. Hackbart

(57) ABSTRACT

A crossbow 100 includes a rifle-style stock 22, barrel 23, bowstring 1, and a string release housing 21 with a novel string release assembly. The string release assembly in string release housing 21 includes a string latch 12 for retaining fully-drawn and cocked bowstring 1 against a string horn 19, a trigger 6 for releasing or shooting the arrow 2, a safety button 25 for the movement of the safety plate 7 from the safe position to the fire position, and a load lever 4 for loading the arrow 2. There is a safety button 25 on each side of the release housing 21 so that the safety of crossbow 100 may be operated by a right-handed or left-handed shooter. Bowstring 1 rests against the inclined surface 29 of the string horn 19 and is retained in the fully-drawn and cocked position between the string latch tangs 30 and 31 and the inclined surface 29 of the string horn 19. The load of the fully-drawn bowstring 1 is distributed between and born by the inclined the string latch tangs 30 and 31 and the inclined surface 29 of string horn 19.

10 Claims, 11 Drawing Sheets

STRING RELEASE FOR A CROSSBOW

TECHNICAL FIELD

The present invention relates generally to the field of archery string releases, and more particularly to an improved string release for crossbows.

BACKGROUND

Prior art string releases for crossbows typically include a string latch that bears the full load of the bowstring at full draw. For example, the string latch 42 in the crossbow string release shown in FIG. 3 of U.S. Pat. No. 5,649,520 includes an arm 74 with a tang 76 that bears the full load of the bowstring when cocked at full draw. Repeated firing of such prior art string releases causes substantial wear to and limits the usable life of the bowstring and bowstring serving of the crossbow since such string release tangs bear the full load of the bowstring when drawn. Accordingly, there is a need for an improved string release for crossbows that reduces the load on the string release tangs when cocked at full draw thereby substantially increasing the useable life of the bowstring and bowstring serving and preventing premature damage.

Also, with prior art crossbow string releases, if a shooter moves the safety from the fire position to the safe position after a shot, the engaged safety will prevent the shooter from re-cocking the bow. Accordingly, there is a need for an improved string release for crossbows that includes a safety that moves to the safe position only during the cocking process.

Furthermore, some prior art crossbow string releases include an arrow retention device and a separate independent anti-dry fire system that will not allow to bow to fire unless an arrow is loaded. Accordingly, there is a need for an improved string release for crossbows that includes an anti dry fire system that also serves as an arrow retention device thereby eliminating the need for a prior art arrow retention spring 34 as shown in FIG. 2 of U.S. Pat. No. 5,649,520.

DETAILED DESCRIPTION OF THE DRAWINGS

In FIGS. 1 to 7, there is illustrated a first embodiment of a string release assembly for a crossbow, illustrative of the present disclosure. In FIG. 8, there is illustrated a second embodiment of the string release assembly for a crossbow, illustrative of the present disclosure. It should be understood that similar components in FIGS. 1 to 8 of the drawings will have the same reference numbers throughout the drawings.

Figure 1:
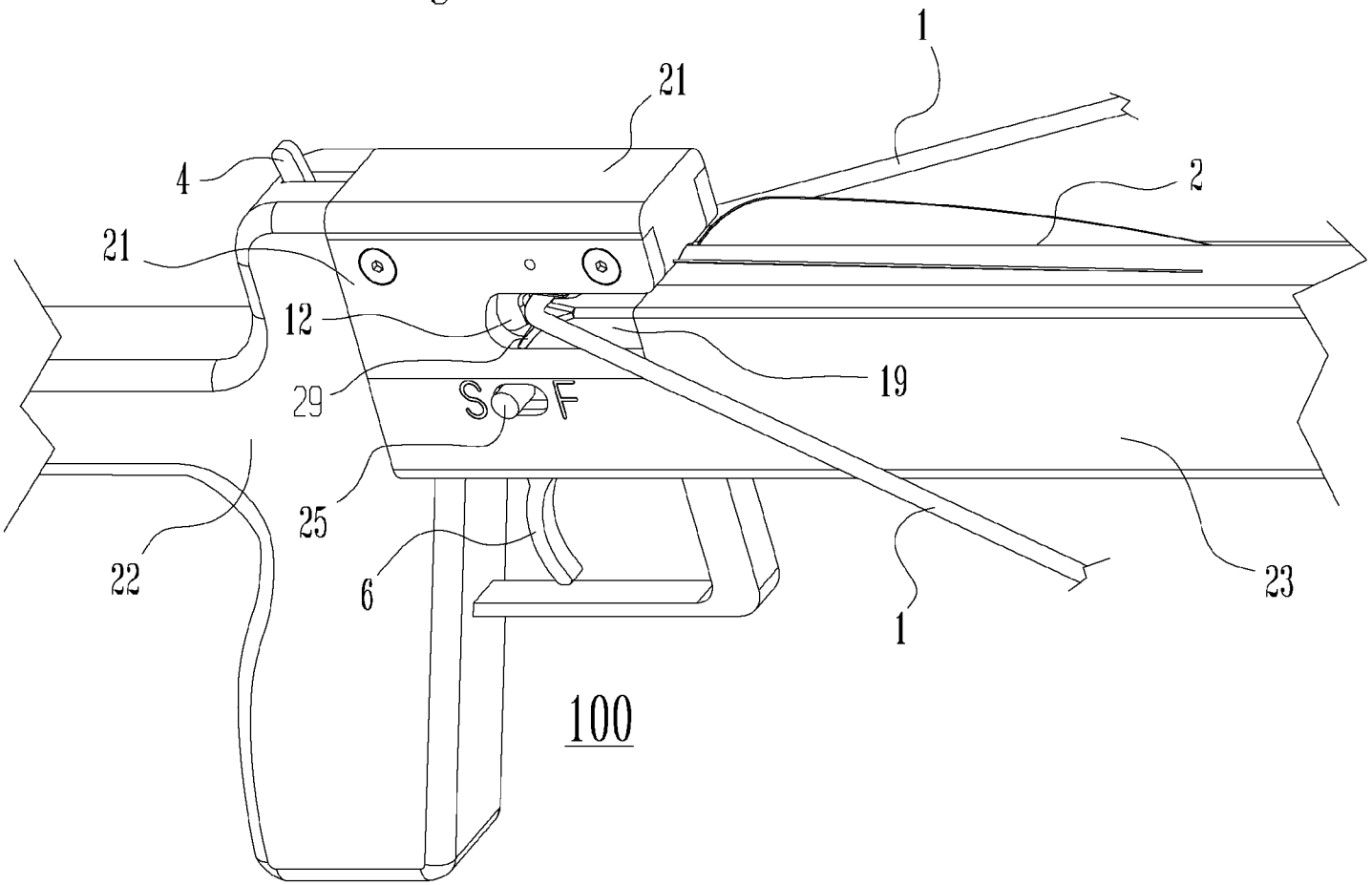
FIG. 1 is a front right-side partial perspective view of a crossbow with a rifle-style stock, a barrel, a bowstring, a string release housing with string release assembly, and an arrow resting on the barrel at full draw.

Referring now to FIG. 1, there is illustrated a front right-side partial perspective view of a crossbow 100 having a bore end and a butt end with a rifle-style stock 22, a barrel 23 coupled to a riser at the bore end, first and second limbs coupled to the riser and having respective first and second cams each rotatable about a respective axle, a bowstring 1 extending between the first and second cams and shown at full draw, a string release housing 21 with string release assembly, and a bolt or arrow 2 with three fletchings resting on a slot in the barrel 23. One of the fletchings of the arrow 2 inserts into the slot in the barrel 23 (see FIG. 6). The crossbow 100 may alternatively include a barrel into which a bolt or arrow 2 inserts, as depicted in my U.S. Pat. Nos. 7,823,572 and 8,157,680, each of which is incorporated herein in its entirety by reference. The string release assembly in string release housing 21 includes a string latch 12 for retaining fully-drawn and cocked bowstring 1 against string horn 19, a trigger 6 for releasing or shooting the arrow 2, a safety button 25 for the movement of the safety plate 7 (see also FIGS. 2A and 2B) from the safe position to the fire position, and a load lever 4 for loading the arrow 2. There is a safety button 25 on each side of the release housing 21 so that the safety of crossbow 100 may be operated by a right-handed or left-handed shooter. As a result, crossbow 100 may be shot by a right-handed or left-handed shooter without making any adjustments. Bowstring 1 rests against the inclined surface 29 (see FIG. 2A and FIG. 2B) of the string horn 19 and is retained in the fully-drawn and cocked position by string latch 12. The load of the fully-drawn bowstring 1 is distributed between and born by the inclined surface 29 (see FIG. 2A and FIG. 2B) of string horn 19 and the string latch tangs 30 and 31 (see FIG. 2A). In the embodiment of the string horn 19 in FIGS. 1 to 7, the inclined surface 29 of the string horn 19 is at substantially forty-five degrees relative to the top surface 45 (see FIGS. 2A and 2B) of the string horn 19 and bears approximately fifty percent of the load of the bowstring 1 at full draw, while the remaining fifty percent of the load of the bowstring 1 is born by the string latch tangs 30 and 31 (see FIG. 2A). Since the string horn 19 bears approximately fifty percent of the load, the usable life of the bowstring and bowstring serving is substantially increased. In other embodiments of the string horn 19, the inclined surface 29 of the string horn 19 may be at other angles, such as for example, angles of more or less than forty-five degrees. The string latch 12, the string horn 19 and other components of the string release assembly in the string release housing 21 in the crossbow 100 in FIG. 1 may be advantageously utilized on any crossbow including, for example, the crossbow shown and described in my U.S. Pat. Nos. 7,823,572 and 8,157,680, each of which is incorporated herein in its entirety by reference.

Figure 2A:
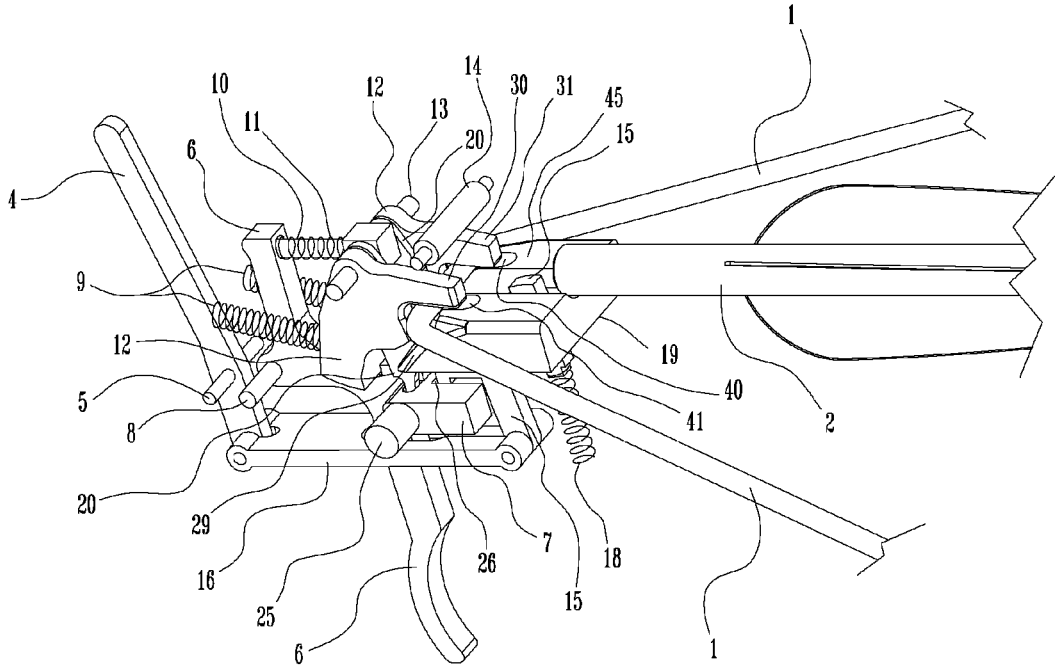
FIG. 2A is a front right-side perspective view of the string latch, the string horn and other components in the string release assembly removed from the string release housing in FIG. 1 with an arrow partially loaded.

Referring to FIG. 2A, there is illustrated a front right-side perspective view of the string latch 12, the string horn 19 and other components in the string release assembly in the string release housing 21 in FIG. 1 with an arrow partially loaded. The string latch 12 is in the cocked position with the tangs 30 and 31 of the string latch holding bowstring 1 in position against the inclined surface 29 of the string horn 19. Tangs 30 and 31 also insert partially into recesses 40 and 41 (see also FIG. 3B), respectively on the top surface 45 of the string horn 19, when string latch 12 is in the cocked position. The top surface 45 of the string horn 19 also has a groove into which the arrow 2 slides to engage the cocked bowstring 1. The string horn 19 also has beveled top edges where the bowstring 1 wraps around the string horn 19 when in the cocked position. The safety button 25 is in the "safe" position in the string release assembly in FIG. 2A and cannot be moved forward to the "fire" position since movement of the safety plate 7 is blocked by the tang 26 of the arrow hold plunger 15 (see also FIG. 4A), thus preventing "dry firing" or discharging the crossbow 100 when an arrow 2 is not loaded. Arrow load lever 4 rotates about pivot pin 5 and is coupled to arrow hold plunger 15 by linkage arm 16. When the arrow 2 is loaded by moving the arrow load lever 4 forward, the arrow hold plunger 15 rotates about pivot pin 17 (see FIG. 3A) allowing the arrow 2 to slide or move in the groove in the top surface 45 of the string horn 19 toward and engage the bowstring 1. When the arrow load lever 4 is released, the loaded arrow 2 is biased by spring 18 to hold the loaded arrow 2 in place (see FIG. 6). When the safety buttons 25 are moved forward to the "fire" position and the crossbow 100 with the loaded arrow 2 is fired by pulling the trigger 6, the string latch 12 rotates upward about pivot point 13 and tangs 30 and 31 will rest against bumper 14 and be held in place by latch springs 9 (see also FIG. 2B). The trigger 6 rotates about pivot pin 8 when pulled and is tensioned by trigger spring 11 disposed on guide pin 10 (see also FIG. 3A). Arrow load lever 4 rotates about pivot pin 5 and is coupled to arrow hold plunger 15 by linkage arm 16.

Figure 2B:
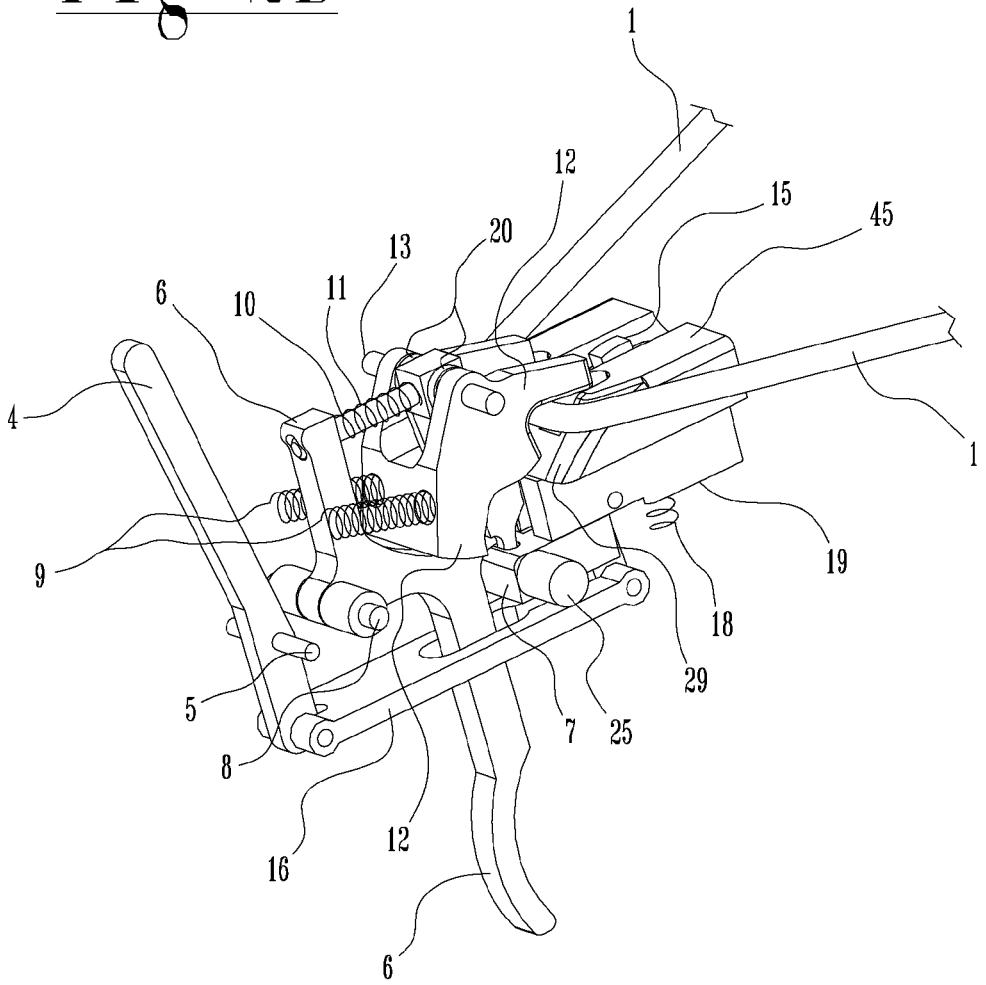
FIG. 2B is a rear right-side perspective view of the string latch, the string horn and other components in the string release assembly in FIG. 2A.

Referring to FIG. 2B, there is illustrated a rear right-side perspective view of the string latch 12, the string horn 19 and other components in of the string release assembly in FIG. 2A. The inclined surface 29, beveled top edges and top surface 45 of the string horn 19 are depicted in the view in FIG. 2B (see also FIG. 3B). The safety movement bars 20 that rotate about pivot point 13 each have tangs that insert into corresponding holes 52 in the safety plate 7 (as shown in FIG. 4A and FIG. 4B).

Figure 3A:
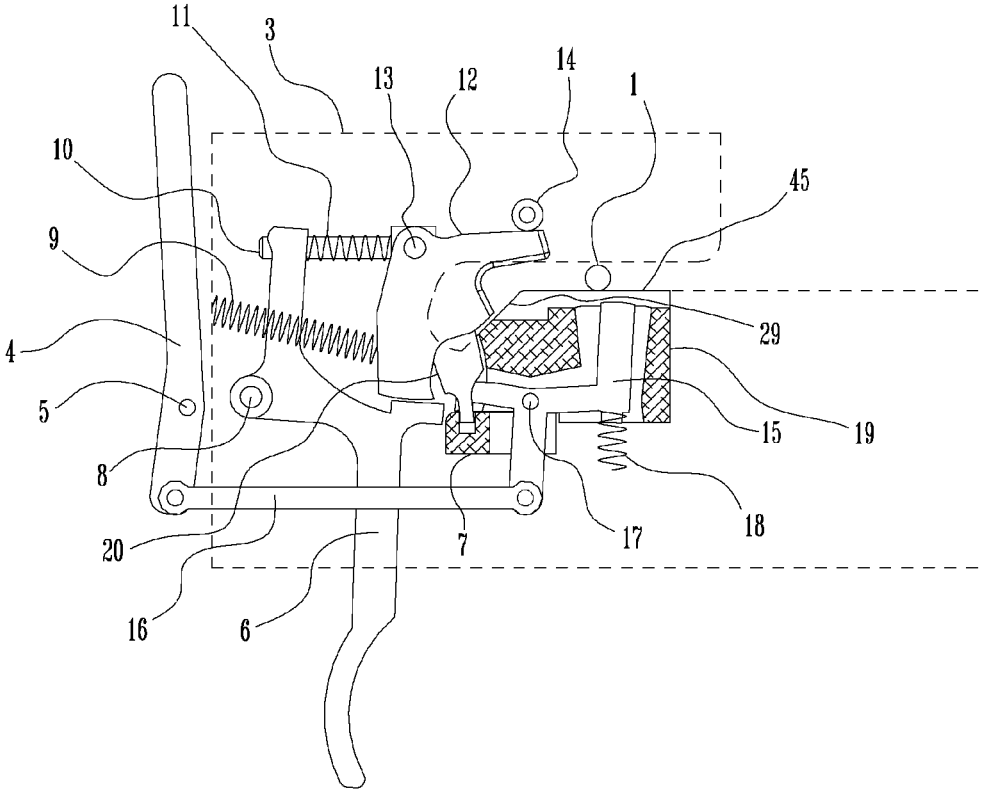
FIG. 3A is a side view of the string release assembly in the string release housing in FIG. 1 (shown as hidden by dashed lines 3), with the string latch ready to cock and the bowstring partially pulled back and resting on the top surface of the string horn, together with a cross section of the string horn taken along lines A to A in the top view of the string horn in FIG. 3B, and together with a cross section of the safety plate taken along lines B to B in the top view of the safety plate in FIG. 4B.
Figure 3B:
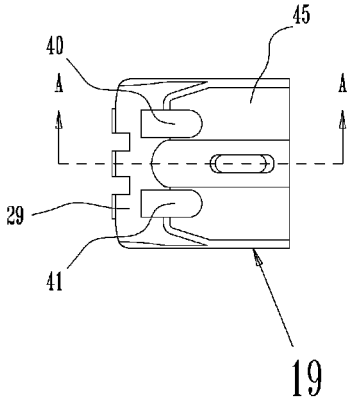
FIG. 3B is a top view of the string horn in FIG. 2B.
Figure 4A:
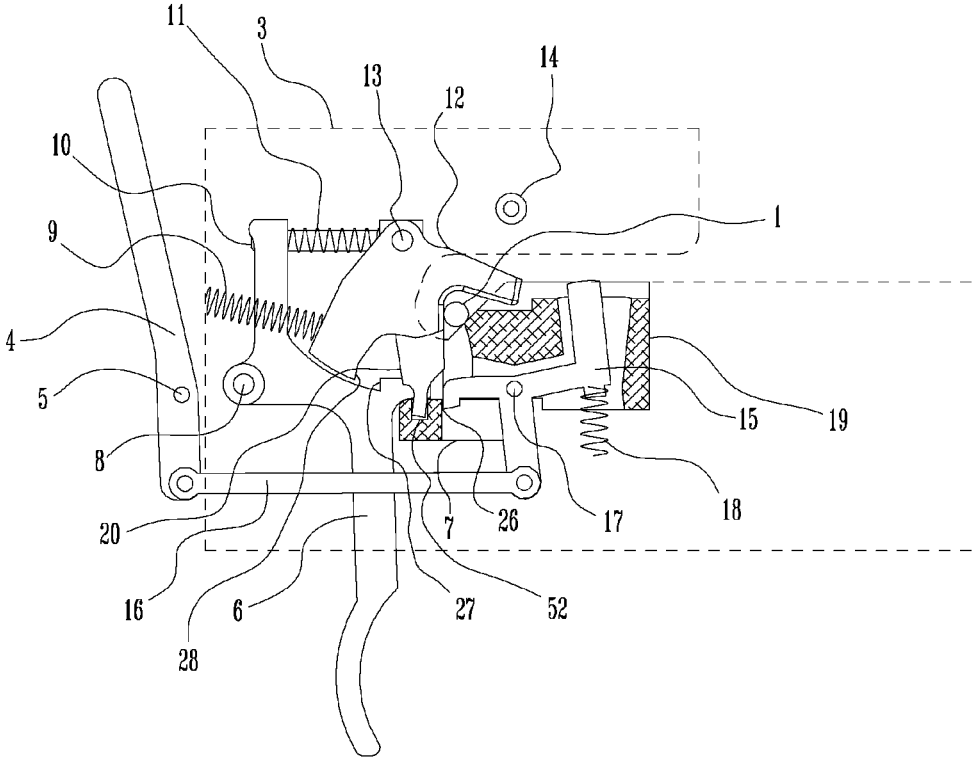
FIG. 4A is a side view of the string release assembly in the string release housing in FIG. 1 (shown as hidden by dashed lines 3), with the string latch over-cocked to allow the bowstring to move the safety plate movement bars connected to recesses to automatically engage the safety and with the bowstring captured, together with a cross section of the string horn taken along lines A to A in the top view of the string horn in FIG. 3B, and together with a cross section of the safety plate taken along lines B to B in the top view of the safety plate in FIG. 4B.
Figure 4B:
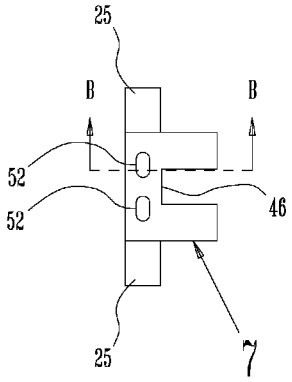
FIG. 4B is a top view of the safety plate in FIG. 2A, FIG. 2B, FIG. 3A, FIG. 3B, FIG. 4A, FIG. 5, FIG. 7 and FIG. 8.

FIG. 3A is a side view of string release assembly in the string release housing 21 in FIG. 1 (shown as hidden by dashed lines 3), with the string latch 12 ready to cock and the bow string 1 partially pulled back and resting on the top surface 45 of the string horn 19, together with a cross section of the string horn 19 taken along lines A to A in the top view of the string horn in FIG. 3B and together with a cross section of the safety plate 7 taken along lines B to B in the top view of the safety plate 7 in FIG. 4B. The arrow hold plunger 15 is rotated down about the pivot point 17, the safety plate 7 is in the fire position, and the string latch 12 is against the bumper 14 so that the bowstring 1 can be pulled back against the string latch 12 to begin the cocking process.

Referring to FIG. 3B, there is illustrated a top view of the string horn 19 in FIG. 2B. The inclined surface 29, the top surfaces 45 and the recesses 40 and 41 are depicted in FIG. 3B.

FIG. 4A is a side view of the string release assembly in the string release housing 21 in FIG. 1 (shown as hidden by dashed lines 3), with the string latch 12 over-cocked to allow the bowstring 1 to move the safety plate movement bars 20 (see also FIG. 2A) connected to the recesses 52 (see also FIG. 4B) to automatically engage the safety and with the bowstring 1 captured by the string latch 12 and resting on the inclined surface 29 of the string horn 19, together with a cross section of the string horn 19 taken along lines A to A in the top view of the string horn in FIG. 3B and together with a cross section of the safety plate 7 taken along lines B to B in the top view of the safety plate 7 in FIG. 4B. The bowstring 1 in FIG. 4A has been pulled back and moves down along the inclined surface 29 of string horn 19, rotates sear surface 28 of string latch 12 back past the sear surface 27 of the trigger 6, and automatically places the safety plate 7 in the "safe" position and the arrow hold plunger 15 is rotated so that tang 26 of the arrow hold plunger 15 blocks movement of the safety plate 7 forward from the "safe" position to prevent dry firing until the arrow 2 is loaded in the crossbow 100.

Referring to FIG. 4B, there is illustrated a top view of the safety plate 7 in FIG. 2A, FIG. 2B, FIG. 3A, FIG. 4A, FIG. 5, FIG. 7 and FIG. 8. The safety buttons 25 and recesses 52 of the safety plate 7 are depicted in FIG. 4B. When in the "safe" position, the tang 26 of the arrow hold plunger 15 blocks forward movement of the center portion 46 of the safety plate 7 (see FIG. 2A and FIG. 4A).

Figure 5:
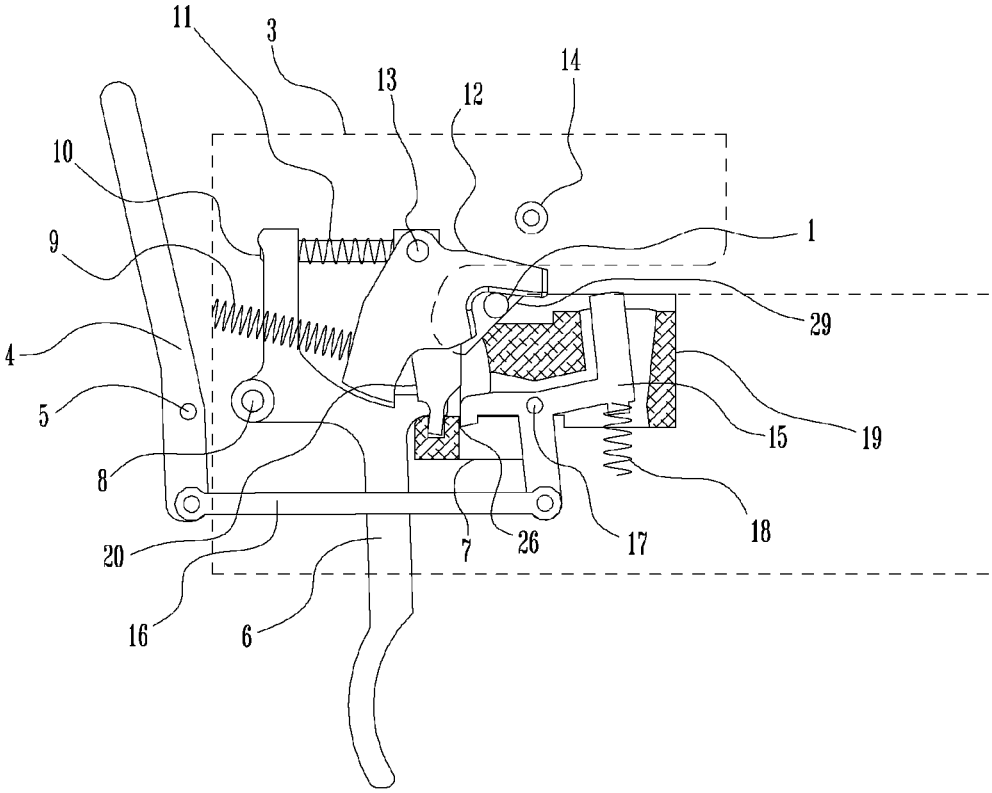
FIG. 5 is a side view of the string release assembly in the string release housing in FIG. 1 (shown as hidden by dashed lines 3), with the string latch latched, the safety movement buttons and the safety plate in the safe position, together with a cross section of the safety plate taken along lines B to B in the top view of the safety plate in FIG. 4B and the bowstring captured by the string latch and resting on the inclined portion of the string horn, and together with a cross section of the string horn taken along lines A to A in the top view of the string horn in FIG. 3B and together with a cross section of the safety plate taken along lines B to B in the top view of the safety plate in FIG. 4B.

FIG. 5 is a side view of the string release assembly in the string release housing 21 in FIG. 1 (shown as hidden by dashed lines 3), with the string latch 12 latched, the safety movement buttons 25 (see FIG. 1 and FIG. 4B) and safety plate 7 in the "safe" position, and the bowstring 1 captured by the string latch 12 and resting on the inclined portion of the string horn 29, together with a cross section of the string horn 19 taken along lines A to A in the top view of the string horn in FIG. 3B and together with a cross section of the safety plate 7 taken along lines B to B in the top view of the safety plate 7 in FIG. 4B. The bowstring 1 in FIG. 5 has moved up along the inclined surface 29 of string horn 19, rotating sear surface 28 (see FIG. 4A) of the sting latch 12 forward so it contacts the sear surface 27 (see FIG. 4A) of the trigger 6. The safety plate 7 remains in the "safe" position with the tang 26 of arrow hold plunger 15 blocking movement of the safety buttons 25 and the safety plate 7 from the "safe" position forward to the "fire" position until the arrow 2 is loaded in the crossbow 100.

Figure 6:
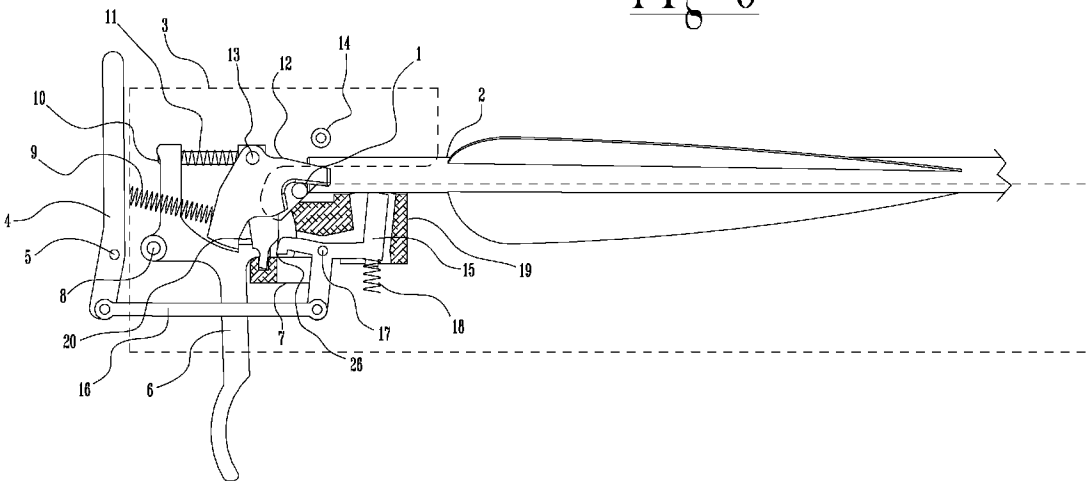
FIG. 6 is a side view of the string release assembly in the string release housing in FIG. 1 (shown as hidden by dashed lines 3), with the safety plate in the safe position and the arrow loaded into the crossbow.

FIG. 6 is a side view of the string release assembly in the string release housing 21 in FIG. 1 (shown as hidden by dashed lines 3), with the safety plate 7 in the "safe" position and the arrow 2 loaded into the crossbow 100. Loading the arrow 2 into the crossbow 100 requires the forward movement of the top of arrow load lever 4 which causes the arrow hold plunger 15 to move down (allowing the arrow 2 to slide back to the bowstring 1) and rotate tang 26 up so it no longer blocks movement of the safety buttons 25 and the safety plate 7 from the "safe" position forward to the "fire" position.

Figure 7:
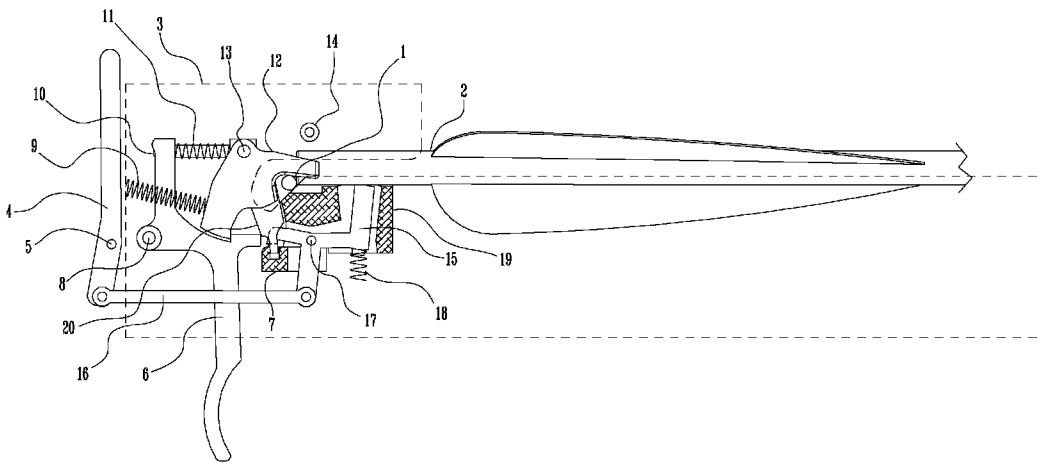
FIG. 7 is a side view of string release assembly in the string release housing in FIG. 1 (shown as hidden by dashed lines 3), with the safety place in the fire position and the arrow loaded into the crossbow.
Figure 8:
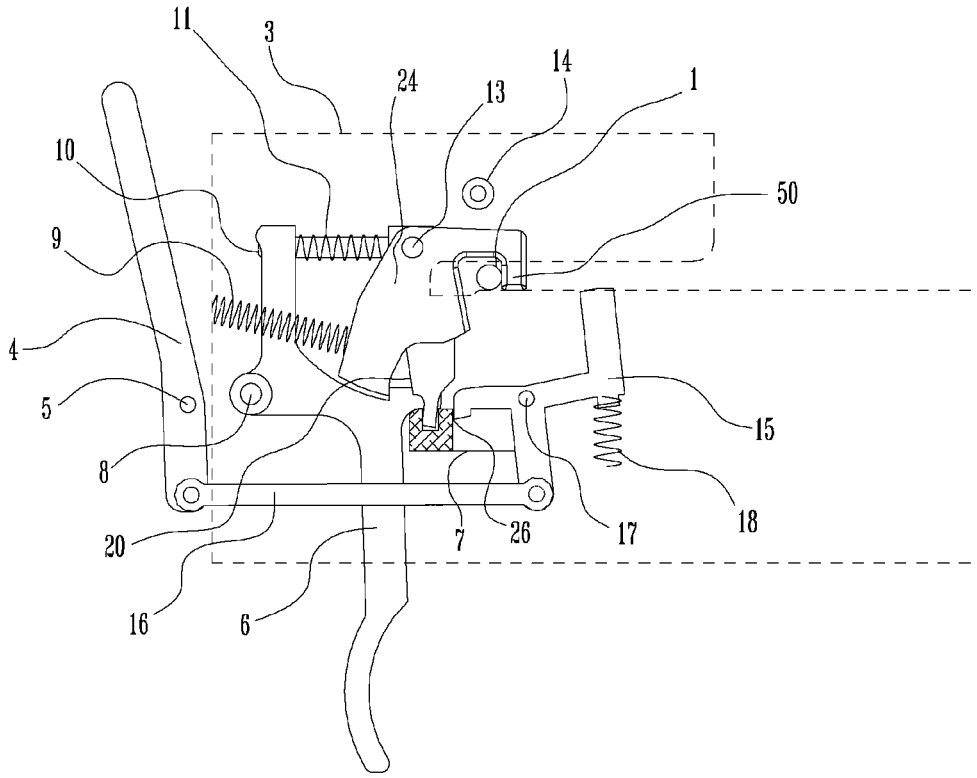
FIG. 8 is a side view of the string release assembly in FIG. 5, with an alternate embodiment of an L-shaped string latch, where the crossbow is cocked and the bowstring is captured by the tangs of the string latch.

FIG. 7 is a side view of the string release assembly in the string release housing 21 in FIG. 1 (shown as hidden by dashed lines 3), with the safety plate 7 in the "fire" position and the arrow 2 loaded into the crossbow 100. A shooter has moved the safety buttons 25 (see FIG. 1) forward causing safety plate 7 to move to the "fire" position so that the trigger 6 can be pulled causing the string latch 12 to move upward to release the bowstring 1 and shoot the arrow 2.

FIG. 8 is a side view of components of the string release assembly in the string release housing 21 in FIG. 1 (shown as hidden by dashed lines 3), with an alternate embodiment of an L-shaped string latch 24 cocked and the bowstring 1 captured by the tangs 50 of the string latch 24. In this embodiment, string latch 24 bears the full load of the bowstring 1 at full draw. Otherwise, the trigger 6, the safety plate 7, arrow hold plunger 15 (prevents "dry firing" by blocking movement of the safety plate 7 until the arrow 2 is loaded), and other components in the string release assembly in FIG. 8 operate the same as the corresponding components do in the string release assembly in FIGS. 1 to 7.

While particular embodiments of my invention have been shown and described, modifications may be made. It is therefore intended in the appended claims to cover all such changes and modifications which fall within the true spirit and scope of my invention.

What is claimed is:

1. A string release adapted to release an arrow from a crossbow, comprising:

a string latch having a first sear surface and at least one tang for retaining a bowstring in a drawn position, said string latch and the at least one tang being pivotal about a first pivot point when the bowstring is drawn;

a string horn having a top surface and an inclined surface that is inclined relative to the top surface for engaging the bowstring in a drawn position; and a trigger having a second sear surface, said trigger being pivotal about a second pivot point, when the bowstring is drawn, said first sear surface of the string latch being pivoted to engage said second sear surface of the trigger, the bowstring moving across the top surface and along the inclined surface of the string horn, and the at least one tang of the string latch pivoting about the first pivot point to retain the bowstring against the inclined surface of the string horn, and when the trigger is pivoted about the second pivot point, said second sear surface of the trigger disengaging from the first sear surface of the string latch and the disengaged string latch and the at least one tang pivoting about the first pivot point to release the arrow.

2. The string release according to claim 1, wherein the string latch has a second tang, the at least one tang and the second tang for retaining the bowstring against the inclined surface of the string horn in a drawn position.

3. The string release according to claim 1, wherein the inclined surface of the string horn is inclined at substantially forty-five degrees relative to the top surface.

4. The string release according to claim 1, further including an arrow hold plunger and a safety plate, and the tang of the arrow hold plunger pivoting about a third pivot point when the bowstring is drawn to engage the safety plate and prevent movement of the safety plate from the safe position to a fire position.

5. The string release according to claim 4, wherein the arrow hold plunger is pivoted about the third pivot point when an arrow is loaded to allow movement of the safety plate from the safe position to the fire position.

6. The string release according to claim 1, further including:

a safety plate having at least one hole, the safety plate preventing movement of the trigger when in a safe position;

a safety movement bar having a tang for engaging the at least one hole in the safety plate and being pivotal about the first pivot point when the bowstring is drawn to move the safety plate to the safe position; and when the safety plate is moved to a fire position and the trigger is pivoted about the second pivot point, said second sear surface of the trigger disengaging from the first sear surface of the string latch and the disengaged string latch pivoting about the first pivot point to release the arrow.

7. The string release according to claim 1, further including a crossbow having a bore end and a butt end, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first cam and the second cam; and a stock including a pistol grip, a trigger coupled to the string release, and a barrel extending coupled to the riser at the bore end.

8. A string release adapted to release an arrow from a crossbow, comprising:

a string latch having a first sear surface and at least one tang for retaining a bowstring in a drawn position, said string latch and at least one tang being pivotal about a first pivot point when the bowstring is drawn;

a safety plate having at least one hole;

a safety movement bar having a tang for engaging the at least one hole in the safety plate and being pivotal about the first pivot point when the bowstring is drawn to move the safety plate to a safe position;

a string horn having a top surface and an inclined surface that is inclined relative to the top surface for engaging the bowstring in a drawn position;

a trigger having a second sear surface, said trigger being pivotal about a second pivot point, the safety plate preventing movement of the trigger when in the safe position; and an arrow hold plunger having a tang, the tang of the arrow hold plunger pivotal about a third pivot point;

when the bowstring is drawn, said first sear surface of the string latch being pivoted to engage said second sear surface of the trigger, the bowstring moving across the top surface and along the inclined surface of the string horn, the at least one tang of the string latch pivoting about the first pivot point to retain the bowstring against the inclined surface of the string horn, and the tang of the arrow hold plunger pivoting about the third pivot point to engage the safety plate and prevent movement of the safety plate from the safe position to a fire position;

when an arrow is loaded, the arrow hold plunger is pivoted about the third pivot point to allow movement of the safety plate from the safe position to the fire position, and when the safety plate is moved to the fire position and the trigger is pivoted about the second pivot point, said second sear surface of the trigger disengaging from the first sear surface of the string latch and the disengaged string latch and the at least one tang pivoting about the first pivot point to release the arrow.

9. The string release according to claim 8, wherein the string latch has a second tang, the at least one tang and the second tang for retaining the bowstring against the inclined surface of the string horn in a drawn position.

10. The string release according to claim 8, further including a crossbow having a bore end and a butt end, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first cam and the second cam; and a stock including a pistol grip, a trigger coupled to the string release, and a barrel extending coupled to the riser at the bore end.

* * * * *